US005893174A

United States Patent [19]

Primeau

[11] Patent Number: 5,893,174

[45] Date of Patent: Apr. 13, 1999

[54] NON-DISCARD PROTECTIVE FACEMASK/ HELMET ASSEMBLY

[76] Inventor: Charles W. Primeau, 3304 Yonge St., San Diego, Calif. 92106

[21] Appl. No.: 08/445,540

[22] Filed: May 22, 1995

[51] Int. Cl.[6] ..... A42B 3/20

[52] U.S. Cl. ..... 2/424; 2/10; 2/9

[58] Field of Search ..... 2/9, 10, 11, 422, 2/421, 424, 425, 417, 418

[56] References Cited

U.S. PATENT DOCUMENTS

| | | | |
|---|---|---|---|
| 571,437 | 11/1896 | Gray | 2/9 |
| 991,859 | 5/1911 | Lahan | 2/9 |
| 2,903,700 | 9/1959 | Finken et al. | 2/10 |
| 3,262,125 | 7/1966 | Bowen | 2/10 |
| 3,729,745 | 5/1973 | Latina | 2/9 |
| 3,732,574 | 5/1973 | Hale | 2/9 |
| 4,315,335 | 2/1982 | Kennedy, Jr. et al. | 2/9 |
| 4,651,356 | 3/1987 | Zide | 2/425 |
| 4,847,920 | 7/1989 | Aileo et al. | 2/424 |
| 5,093,936 | 3/1992 | Copeland et al. | 2/424 |

*Primary Examiner*—Michael A. Neas

[57] ABSTRACT

A protective helmet and facemask assembly for use by baseball catchers, umpires, etc. The helmet is configured to cover a person's head, leaving a face area open. A facemask having a frame to fit around a person's face and a protective grid covering the frame is secured to the helmet by elastic straps. The mask can be moved between positions over a person's face to a position frictionally engaging the top of the helmet by pulling the mask slightly away from the helmet and pushing it upward. A chinstrap is provided to help hold the assembly on a person's head. The throat guard may loosely depend from the chinstrap. A suspension including a headband may hold the helmet spaced from the person's head, with the headband adjustable to provide a desired fit.

10 Claims, 1 Drawing Sheet

NON-DISCARD PROTECTIVE FACEMASK/ HELMET ASSEMBLY

BACKGROUND OF THE INVENTION

This invention relates in general to an assembly for protecting a person's head and face against impact injury and, more specifically, to an assembly comprising a helmet with a facemask secured thereto by radial elastic bands which permit the mask to be moved from a position over a person's face to a position on the top of the helmet. While such an assembly is useful in many sports or activities, it is particularly useful for catchers playing baseball, softball and the like.

Many helmets with removable facemasks have been developed to protect the wearer's face and head. Among these are motorcyclist helmets, fire fighter helmets, and various helmets used in sports such as hockey, lacrosse, football and the like. In general, the facemask is formed from transparent plastic or a metal or plastic grid which is semi-permanently fixed to the helmet. In some cases the facemask is removable or pivotable away from the face. Typical of these are the fire fighters' pivotable face shield described by Oleson in U.S. Pat. No. 5,257,417 the hockey helmets add facemasks of Copeland et al shown in U.S. Pat. No. 5,129,108 and of Neeld et al. U.S. Pat. No. 4,021,858 and the motorcycling headgear disclosed by Vitaloni in U.S. Pat. No. 4,689,836. While each of these has utility for the particular use described, in each case the facemask is difficult to remove or pivot out of the way quickly and, where pivoted, is not well restrained in the open position during continued intensive physical activity.

Baseball catchers have long used facemasks including a grid of metal or plastic mesh over the face, a padded rim for engaging the face around the mask, and a harness fitting-over a helmet. The mask must be quickly removed and dropped or thrown to the side in the event of a foul pop-up, a wild pitch, or other action on the field. Each time the mask is removed and dropped, there is a chance that the catcher will trip on the mask and be unable to complete a required action. Further, the mask, which becomes damp with perspiration, becomes covered with dirt when dropped and must be shaken out and possibly wiped off before play can be resumed. Retrieving and cleaning the facemask also delays play.

Increasingly, particularly in youth leagues such as Little League baseball, catchers must wear a helmet to protect their heads against impact injury from bats, balls, collisions, and the like. A combination helmet and mask, which must be rapidly removed and dropped to make plays, is heavy, cumbersome and difficult to remove quickly. Further, if the catcher wears glasses, removal of the helmet and facemask combination is likely to disturb, damage, or knock off the glasses. Because of the need for rapid removal, the existing helmet/facemask sets must fit loosely, and do not maintain an optimum, comfortable position during use.

In order to eliminate the problems associated with rapidly removing a catcher's facemask, dropping it out of the way, and cleaning before reusing, facemasks have been developed which are pivotally secured to a head-encircling band or strap. Lahan, in U.S. Pat. No. 991,859, discloses a catcher's mask secured to a head band by rigid arms or bars by a pivot pin. In use, the facemask is pivoted down over the face, with a strap running from the top of the mask over the head to the back of the headband to prevent the mask from settling to low. When it becomes necessary to remove the mask from the player's face, such as when a pop foul is hit, the mask is swung to the top of the head where a friction latch holds it in place. While sometimes effective, this arrangement has a number of problems. The rigid bars make it difficult to have the mask held tight to the player's face in normal use yet have it easily moveable out of the way. Pushing the mask upward quickly is likely to dislodge the headband, allowing the assembly to drop to the ground, where he or she may trip over it. Further, the latch may fail, allowing the mask to drop over the face at a critical moment when running after a ball. A more positive latch would be difficult to easily release to return the mask to the normal position.

Another catcher's facemask is described by Gray in U.S. Pat. No. 571,437. This mask uses a padded frame surrounding the player's face and a strap around the back of the head to hold the frame in place. A wire mesh mask is pivotally secured to a pivot attached to the frame and headband and is held against the frame by gravity and latched in place. When the mask must be moved out of the way, the latch is released and the mask is swung upward where it is held in place by weight or a latch. Before the mask can be moved out of the way, the hold-down latch must be released. Failure to properly release the latch will result in the facemask remaining in the vision-obstructing position over the face or in the entire assembly being pushed upward over the head, to fall in back of the player. Since the mask is not positively held in place in either position, accidental release of a latch may cause the mask to move to an angled and vision obstructing position partially over the face.

In order to protect the player's throat and underchin, catchers' masks often have an elongated pad or guard hanging loosely from the lower edge of conventional catchers' facemasks. The guard, while important for maximum protection, often strikes the catcher's face or eyes when the mask is being quickly removed.

Thus, there is a continuing need for improved protective helmet and facemask assemblies, in particular for use by catchers participating in games such as baseball, which overcome the above noted problems. In particular, the assembly should be held firmly to the head when the catcher is behind the batter while allowing the facemask portion to be easily moved out of the way when necessary. The facemask should be securely held in place in either of the two positions; namely, over the player's face or on the top of the helmet. Finally, the assembly should avoid the problems of a throat guard sliding across the face during mask removal.

SUMMARY OF THE INVENTION

The above-noted problems, and others, are overcome in accordance with this invention by a protective helmet and facemask combination that basically comprises a close-fitting helmet, preferably formed from high impact strength plastic, having suitable interior padding, a facemask having a padded perimeter for engaging a person's face, a plastic or metal mesh over the face area, and elastic straps connecting the facemask to the helmet for holding the mask against a person's face in a first, or normal use, position and for frictionally holding the facemask against the approximate top of the helmet when the mask is lifted away from the face and slid upward by the user.

A chinstrap is preferably connected to the helmet by snaps or the like to snugly hold the helmet on a person's head. Flexible straps extend between said snaps and a pocket for receiving a person's chin. If desired, the straps may be elastic. A throat guard is preferably loosely attached to the chinstrap at the lowermost portion of the chin strap to depend therefrom in use. The throat guard thus remains in place when the facemask is in either of the two positions.

In order to assure that the helmet will fit different persons snugly, an adjusting device is preferably included. The conventional suspension straps within the helmet, which keep the head spaced slightly from the hard helmet surface, preferably includes a geared strap connection at the back of the helmet, with an adjustment knob extending through the back of the helmet.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
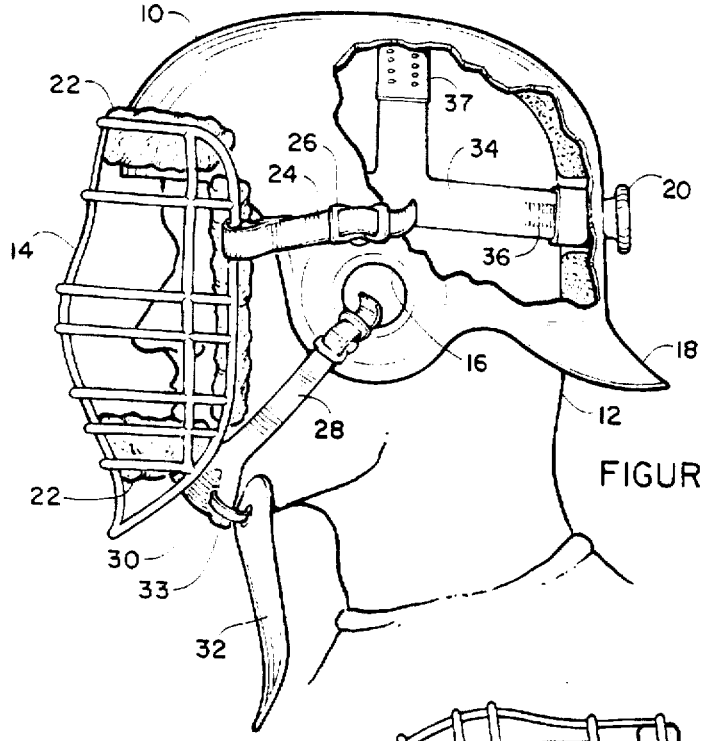
FIG. 1 is a side elevation view of the facemask and helmet assembly of this invention as worn by a player during regular play.

As seen in FIG. 1, during play helmet 10 basically covers the top, back and sides of a person's head 12. Facemask 14 covers the open front of helmet 10. Helmet 10 covers the person's ears with an opening to allow sound to enter. A short projection 18 may be included at the back of helmet 10 to simulate the bill of a reversed baseball cap. Projection 18 will protect the back of the head and neck and the size adjustment knob 20. The combination of helmet 10, facemask 14, and projection 18 protects the player's head from thrown or batted balls, from thrown or trailing bats, and during collisions, such as when blocking a base runner at home plate.

Facemask 14 includes an open grid of wires, high-impact plastic bars, etc., which resist impact from a baseball or the like while permitting good vision. Padding 22 around the edges of facemask 12 absorbs impact forces when struck by a ball or bat. Any suitable mask grid and padding materials may be used.

Facemask 12 is held in place against the persons face and the front of helmet 10 by elastic straps 24 extending between facemask 14 and the sides of helmet 10. Straps 24 may be formed from any suitable elastic material, such as natural or synthetic rubber, elastic fabrics, etc. While straps 24 preferably are wrapped through the grid of facemask 12 and a length adjusting clip 26 and held to helmet 10 by conventional "Gripper" snaps behind clip 26 (not seen), any other suitable attachment arrangement may be used, if desired. Preferably, the connections between straps 24 and helmet 14 permit free strap rotation at that connection.

In order to further hold helmet 10 on the person's head 12, a chinstrap 28 is provided. Chinstrap 28 includes a pocket 30 for receiving the person's chin and two straps which terminate in a clip and snap arrangement for adjusting chinstrap length, and for releasably holding the chinstrap to helmet 10.

In order to protect the person's throat from a bounding ball, foul tip, carelessly swung bat, or the like, a throat guard 32 preferably loosely depends from chinstrap pocket 30. Throat guard 32 is loosely fastened by cords 33 to pocket 30 so that when facemask 14 is moved to the stowed position of FIG. 2 the guard remains in the protective position, rather than being removed with the facemask as is common with prior art facemasks. When a conventional facemask with a throat guard attached thereto is removed during play, the throat guard will pass before the player's eyes, interfering with vision at a critical time.

Figure 2:
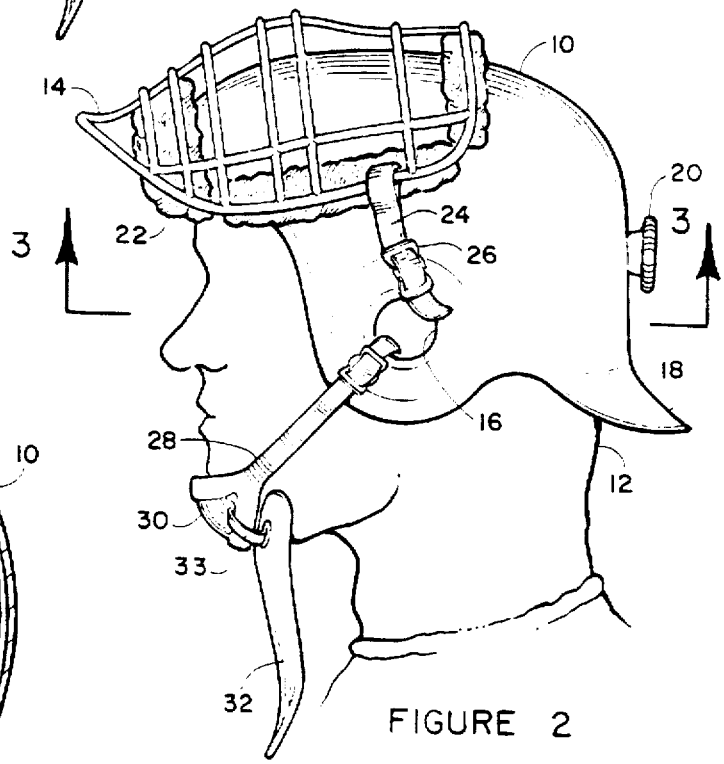
FIG. 2 is a side elevation view of the assembly of FIG. 1 with the mask in the stored or "up" position.

FIG. 2 shows the assembly with facemask 14 in the stored, out-of-the-way or "up" position. Facemask 14 is easily moved from the position of FIG. 1 to that of FIG. 2. This movement is accomplished when a foul pop-up is hit, requiring the person to quickly pursue and catch the ball, when the person backs up first base during play of an infield ground ball thrown to first base, when the person wishes to converse with an umpire or player or at any other time when totally unrestricted vision is desired. The person simply pulls facemask 14 slightly away from the face and pushes it upward to the top of helmet 10. Radial straps 24 have sufficient elasticity to allow this movement and hold the mask firmly in the stored position. Once the person is again ready for play, the facemask is simply pulled back to the position of FIG. 1 where the elastic straps again hold the facemask firmly in place.

Figure 3:
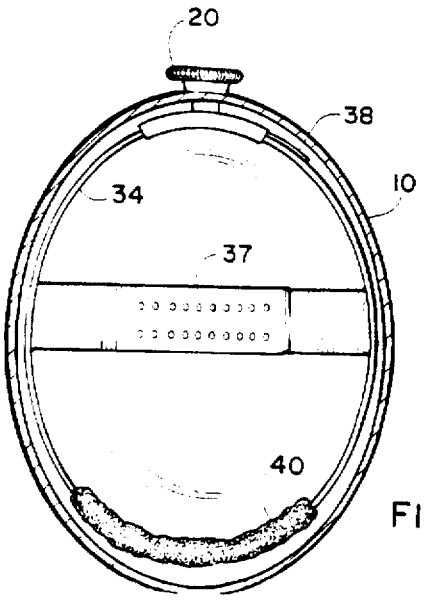
FIG. 3 is an upward view of the helmet interior, showing the size adjustment mechanism.

FIGS. 1 and 3 illustrate a convenient mechanism for quickly and easily adjusting the size of headband 34 which is part of the helmet suspension. Headband 34 is secured to mounting band 37 which is secured to the top interior surface of the helmet with headband 34 spaced slightly from the interior surface. Knob 20 is manually rotated, driving an internal gear (not seen) which engages a rack gear 36 to move end 38 of head band 34 in one direction or the other, to enlarge or decrease the diameter of the headband. Such headband adjustment mechanisms are used with conventional construction helmets, magnifying viewers, and the like. In some cases it is desirable to more securely hold the helmet on the head by angling the back portion of headband 34 downward slightly, so that knob 20 is just above projection 18.

The front portion of headband 34 may include padding 40 to further absorb impacts against facemask 14 or the top front of helmet 10.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A protective helmet and facemask assembly which comprises:

a helmet for covering at least a portion of a person's head, an open face area, and a top portion adjacent to said open face area, said top portion having a top edge bordering said open face area;

a facemask comprising a frame for fitting around a person's face, an open grid of protective elements secured to said frame and covering an area within said frame;

said facemask frame overlapping said top edge;

padding means between said facemask and said edge;

elastic strap means connected between opposite sides of said helmet adjacent to said face area and opposite sides of said facemask for permitting said facemask to be slid from a first position over said face area to a second position over said top portion; and said elastic strap means including means for adjusting the length of said elastic straps to assure snug engagement of said facemask to a person's face in said first position and frictional engagement with said top portion in said second position.

2. The assembly according to claim 1 further including a suspension means within said helmet including a headband spaced from the interior surface of said helmet for fitting around a person's head.

3. The assembly according to claim 2 further including means for changing the length of said headband.

4. The assembly according to claim 1 further including a chinstrap releasably attached to said helmet, said chinstrap includes a pocket for receiving a person's chin, straps connecting said chinstrap to said helmet, and means for adjusting the length of said straps.

5. The assembly according to claim 4 further including a throat guard loosely secured to said pocket and depending therefrom.

6. A protective helmet and facemask assembly which comprises:

a helmet for covering at least a portion of a person's head, an open face area, and a top portion adjacent to said open face area said top portion having a top edge bordering said open face area;

a facemask comprising a padded frame for fitting around a person's face, an open grid of protective elements secured to said frame, and covering an area within said frame;

said facemask overlapping and contacting said top edge;

elastic strap means connected between opposite sides of said helmet adjacent to said face area and opposite sides of said facemask; and means for adjusting the length of said elastic straps to assure snug engagement of said facemask to a person's face in a first position, and frictional engagement with said top portion in a second position;

whereby said helmet may be placed on a person's head with said facemask movable between said first position covering said person's face area and said second position on said top area.

7. The assembly according to claim 6 further including a suspension means within said helmet including a headband spaced from the interior surface of said helmet for engaging a person's head.

8. The assembly according to claim 7 further including means for changing the length of said headband.

9. The assembly according to claim 6 further including a chinstrap comprising a pocket for receiving a person's chin, straps connecting said chinstrap to said helmet, and means for adjusting the length of said straps.

10. The assembly according to claim 9 further including a throat guard loosely secured to said pocket and depending therefrom.

* * * * *